US007669694B2

(12) United States Patent
Seon

(10) Patent No.: US 7,669,694 B2
(45) Date of Patent: Mar. 2, 2010

(54) MUFFLER FOR VEHICLE

(75) Inventor: Jongho Seon, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/483,032

(22) Filed: Jun. 11, 2009

(65) Prior Publication Data

US 2009/0308687 A1 Dec. 17, 2009

(30) Foreign Application Priority Data

Jun. 12, 2008 (KR) ..... 10-2008-0055263

(51) Int. Cl.

| | |
|---|---|
| ***F01N 1/02*** | (2006.01) |
| ***F01N 7/18*** | (2006.01) |
| *F01N 1/00* | (2006.01) |
| *F01N 1/08* | (2006.01) |
| *F01N 7/02* | (2006.01) |

(52) U.S. Cl. ..... 181/269; 181/272; 181/243; 181/232

(58) Field of Classification Search ..... 181/269, 181/272, 282, 268, 281, 250, 243, 241, 275, 181/232

See application file for complete search history.

(56) References Cited

U.S. PATENT DOCUMENTS

| | | | | | |
|---|---|---|---|---|---|
| 1,539,595 | A | * | 5/1925 | Powell | 181/281 |
| 1,800,354 | A | * | 4/1931 | Powell | 181/269 |
| 1,867,273 | A | * | 7/1932 | Lemmerman | 181/243 |
| 2,150,768 | A | * | 3/1939 | Hedrick | 181/275 |
| 2,416,452 | A | * | 2/1947 | Marx | 181/272 |
| 2,567,568 | A | * | 9/1951 | Lievense et al. | 181/272 |
| 3,613,829 | A | * | 10/1971 | Palmer | 181/269 |
| 4,032,310 | A | * | 6/1977 | Ignoffo | 422/170 |
| 4,165,798 | A | * | 8/1979 | Martinez | 181/268 |
| 4,192,401 | A | * | 3/1980 | Deaver et al. | 181/266 |
| 4,235,304 | A | * | 11/1980 | Suyama | 181/265 |
| 4,244,442 | A | * | 1/1981 | Scarton et al. | 181/230 |
| 4,418,789 | A | * | 12/1983 | Eckert | 181/255 |
| 4,874,062 | A | * | 10/1989 | Yanagida et al. | 181/250 |
| 4,880,078 | A | * | 11/1989 | Inoue et al. | 181/232 |
| 5,245,140 | A | * | 9/1993 | Wu | 181/232 |
| 5,266,755 | A | * | 11/1993 | Chien | 181/252 |

(Continued)

FOREIGN PATENT DOCUMENTS

| | | |
|---|---|---|
| JP | 2002-089230 A | 3/2002 |

(Continued)

*Primary Examiner*—Edgardo San Martin
(74) *Attorney, Agent, or Firm*—Morgan, Lewis & Bockius LLP

(57) ABSTRACT

A muffler of a vehicle includes a first muffler body so as to form a first chamber, at least a second muffler body including a housing, one end portion opened and the other end portion closed, wherein one of the second muffler bodies is fitted into the other end portion of the first member to form a second chamber and the other second muffler bodies are fitted into each other through the one end portions in series to form third chambers if more than one second muffler bodies are assembled, an inflow pipe to connect the outside with the first, second and/or third chamber by passing the one end portion of the first muffler body, and an outflow pipe to communicate the first, second, and/or third chamber with the outside by passing through the other end portion of the last second muffler body.

19 Claims, 8 Drawing Sheets

U.S. PATENT DOCUMENTS 5,708,237 A * 1/1998 Maeda et al. ..... 181/254
6,543,577 B1 * 4/2003 Ferreira et al. ..... 181/282
6,983,820 B2 * 1/2006 Boast et al. ..... 181/249
2005/0224283 A1 * 10/2005 Yokoi et al. ..... 181/268
2006/0124384 A1 * 6/2006 Tary et al. ..... 181/243

FOREIGN PATENT DOCUMENTS

KR 10-2007-0003465 A 1/2007

* cited by examiner

MUFFLER FOR VEHICLE

CROSS-REFERENCE TO RELATED APPLICATIONS

The present application claims priority to Korean Patent Application Number 10-2008-0055263 filed Jun. 12, 2008, the entire contents of which application is incorporated herein for all purposes by this reference.

BACKGROUND OF THE INVENTION

1. Field of the Invention

The present invention relates to a muffler for a vehicle, particularly a muffler, of which the muffler housing is integrally formed with a baffle, for a vehicle.

2. Description of Related Art

Mufflers for vehicles in the related art has a structure in which a plurality of chambers is formed by disposing one or more baffle in a closed housing having a predetermined volume, and an exhaust gas inflow pipe through which exhaust gas flows into the housing and an exhaust gas outflow pipe through which the exhaust gas is discharged outside the housing are disposed such that the exhaust gas flowing into the housing flows along a predetermined exhaust path in the housing and is discharged with the pressure and noise reduced to the outside.

FIG. 1 shows a perspective view of a muffler according to the related art, which includes an upper housing 1 and a lower housing 2 that are welded at the edges or combined with each other by bending to define a predetermined closed volume, a plurality of baffles 3 that divides the closed space inside the housing into a plurality of chambers, an exhaust gas inflow pipe 4 through which exhaust gas discharged from an engine flows into the housing, and an exhaust gas outflow pipe 5 through which exhaust gas of which the pressure and noise are decreased while flowing along a predetermined path in the housing is discharged outside the housing.

FIG. 2 shows a perspective view of another muffler according to the related art, which includes a cylindrical housing 11 that is rolled with openings at both sides by welding the overlapping edges or combining the edges by bending, end caps 12 that close the openings at both sides of the housing to define a predetermined closed volume, a plurality of baffles 13 that is disposed inside to divide the closed space formed by the housing and the end caps into a plurality of chambers, an exhaust gas inflow pipe 14 through which gas discharged from an engine flows into the housing, and an exhaust gas outflow pipe 15 through which exhaust gas of which the pressure and noise are decreased while flowing along a predetermined path in the housing is discharged outside the housing.

However, according to the structures of the mufflers in the related arts, there was a problem in that since the housings and baffles, which are formed of similar materials having similar thicknesses, are separately manufactured and assembled, molds for respectively manufacturing them and jigs and tools for assembling them are required, such that the manufacturing process of the mufflers is complicated and the manufacturing cost of a vehicle increases.

Further, there was a problem in that since it is required to develop new molds, depending on the capacities of the mufflers, which are different for the types and engines of vehicles, the investment cost increases.

Further, there was a problem in that the inner sides of the housings and the edges of the baffles are not in close contact with each other due to manufacturing defective of each parts or bad placement of the baffles when the housing and the baffles are assembled, such that gaps are defined and the gaps causes vibration and noise while vehicles are traveling, thereby reducing ride comfort of the vehicles.

In addition, as shown in FIG. 3, in a duel muffler having mufflers disposed at the left and right sides of the rear portion of a vehicle, it was required to individually manufacture the left muffler and the right muffler because their up/down shapes are different, even if they have the same capacity and internal structure.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a muffler for a vehicle that can prevent noise and vibration by integrally manufacturing a housing with baffles, be widely used for all types and engines of vehicles, and makes it possible to reduce investment and development cost for molds and manufacturing cost of vehicles.

In an aspect of the present invention, a muffler for a vehicle may include a first muffler body including a housing, one end portion and the other end portion which are closed so as to form a first chamber therein, at least a second muffler body including a housing, one end portion which is opened and the other end portion which is closed, wherein one of the second muffler bodies is configured to be fitted into the other end portion of the first member to form a second chamber therein and the other second muffler bodies are configured to be fitted into each other through the one end portions thereof in series to form third chambers therein in case that more than one second muffler bodies are assembled, an inflow pipe configured and dimensioned to fluid-connect the outside with the first, second and/or third chamber by passing the one end portion of the first muffler body into the muffler, and an outflow pipe configured and dimensioned to fluid-communicate the first, second, and/or third chamber with the outside by passing through the other end portion of the last second muffler body into the muffler.

The first muffler body may include an opening at the one end portion thereof and a through hole at the other end portion thereof to receive the inflow pipe therethrough, wherein a boss is formed around the through hole at the other end portion to receive the inflow pipe therethrough.

The other end portion of the first muffler body may include at least a punched hole.

The second muffler body may include a through hole at the other end portion thereof to receive the outflow pipe therethrough, wherein a boss is formed around the through hole at the other end portion thereof to receive the outflow pipe therethrough.

The other end portion of the second muffler body may include at least a punched hole.

The housings of the first and second muffler bodies respectively include a large-diameter portion and a small-diameter portion, and an assembly guide step is integrally formed therebetween to connect the large-diameter portion and the small-diameter portion.

An outer diameter of the small-diameter portion in each muffler body may be approximately the same as an inner diameter of the large-diameter portion of neighboring muffler body.

The inflow pipe may be connected to an engine so as to receive exhaust gas and thus the exhaust gas is discharged outside the muffler through the outflow pipe.

The one end portion of the first muffler body may include an end cap that closes the first muffler body.

A front end of the inflow pipe may extend beyond a rear end of the outflow pipe in the muffler.

At least a punched hole may be formed around the inflow pipe, wherein the punched holes of the inflow pipe are disposed in one of the first, second, and/or third chambers.

At least a punched hole may be formed around the outflow pipe, wherein the punched holes of the outflow pipe are disposed in one of the first, second, and/or third chambers.

A center axis of the inflow pipe may be disposed offset from a center axis of the first muffler body in a longitudinal direction thereof.

A center axis of the outflow pipe may be disposed offset from a center axis of the second muffler body in a longitudinal direction thereof.

In another aspect of the present invention, a duel muffler may be formed by disposing a plurality of mufflers as defined in claim 1, which is composed of the one or more first muffler bodies and the one or more second muffler bodies fitted in the first muffler bodies, to the left and right sides of the vehicle, wherein each inflow pipe of the mufflers is connected to an engine.

According to various aspects of the present invention, the muffler for a vehicle, since it is possible to achieve an appropriate muffler according to types of vehicles or capacity of engines, by appropriately combining a plurality of muffler bodies having integrally formed baffles and a housing, it is possible to basically prevent vibration or noise of the muffler due to spacing between the baffles and housing. Further, since it does not need to individually manufacture the baffles and combine the baffles with the housing, molds for manufacturing the baffles or jigs or tools for assembling the baffle with the housing are not required, thereby reducing the manufacturing cost of the muffler. Furthermore, since the muffler is achieved by manufacturing muffler bodies having the same shape using one mold and assembling them, common use and standardization of the muffler are possible. In addition, since left and right mufflers can be achieved by turning one muffler up/down, for a duel muffler, it is possible to reduce cost for molding and manufacturing.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
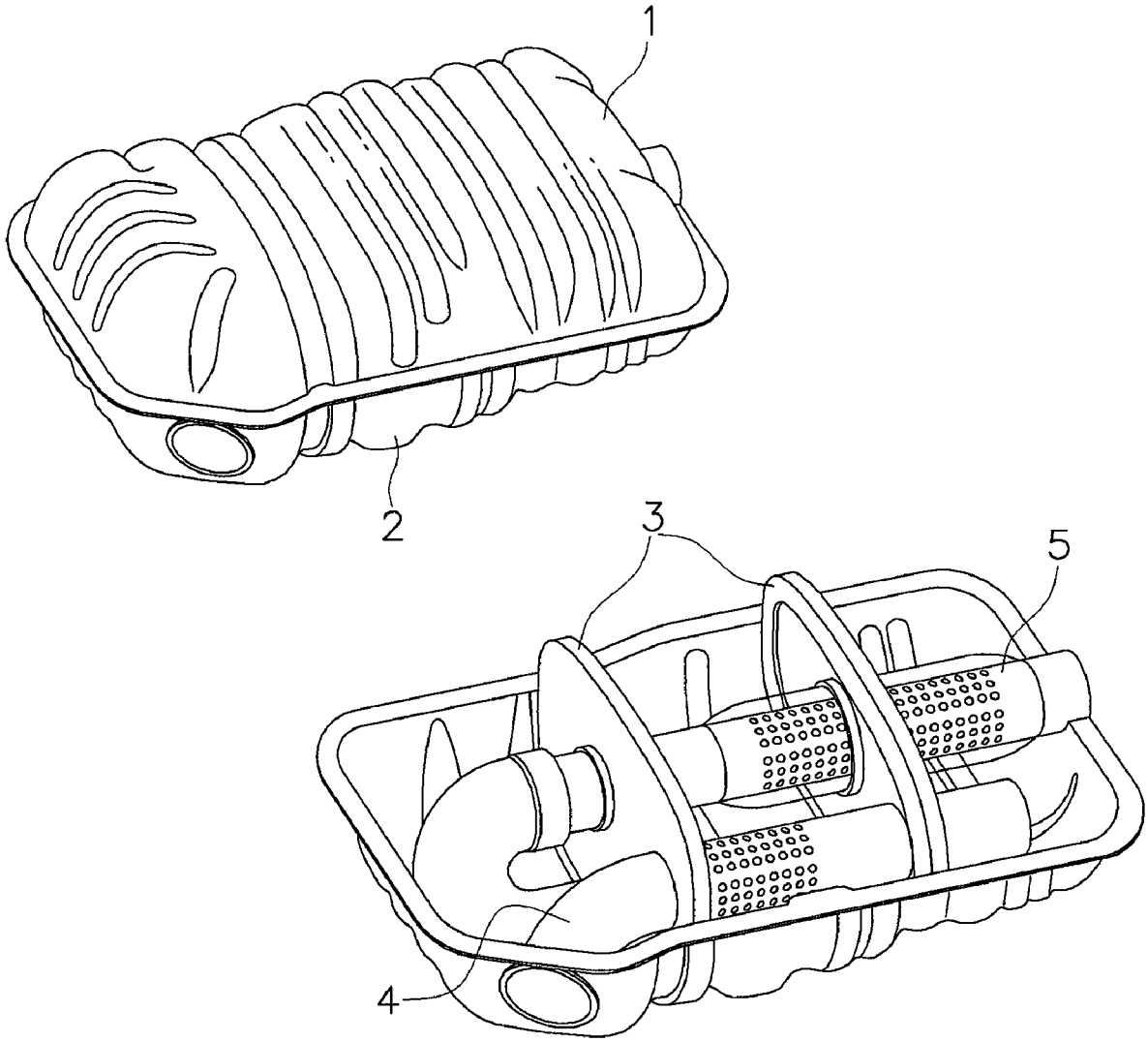
FIG.1 (Prior Art)
FIG. 1 is a perspective view of a muffler according to the related art.
Figure 2:
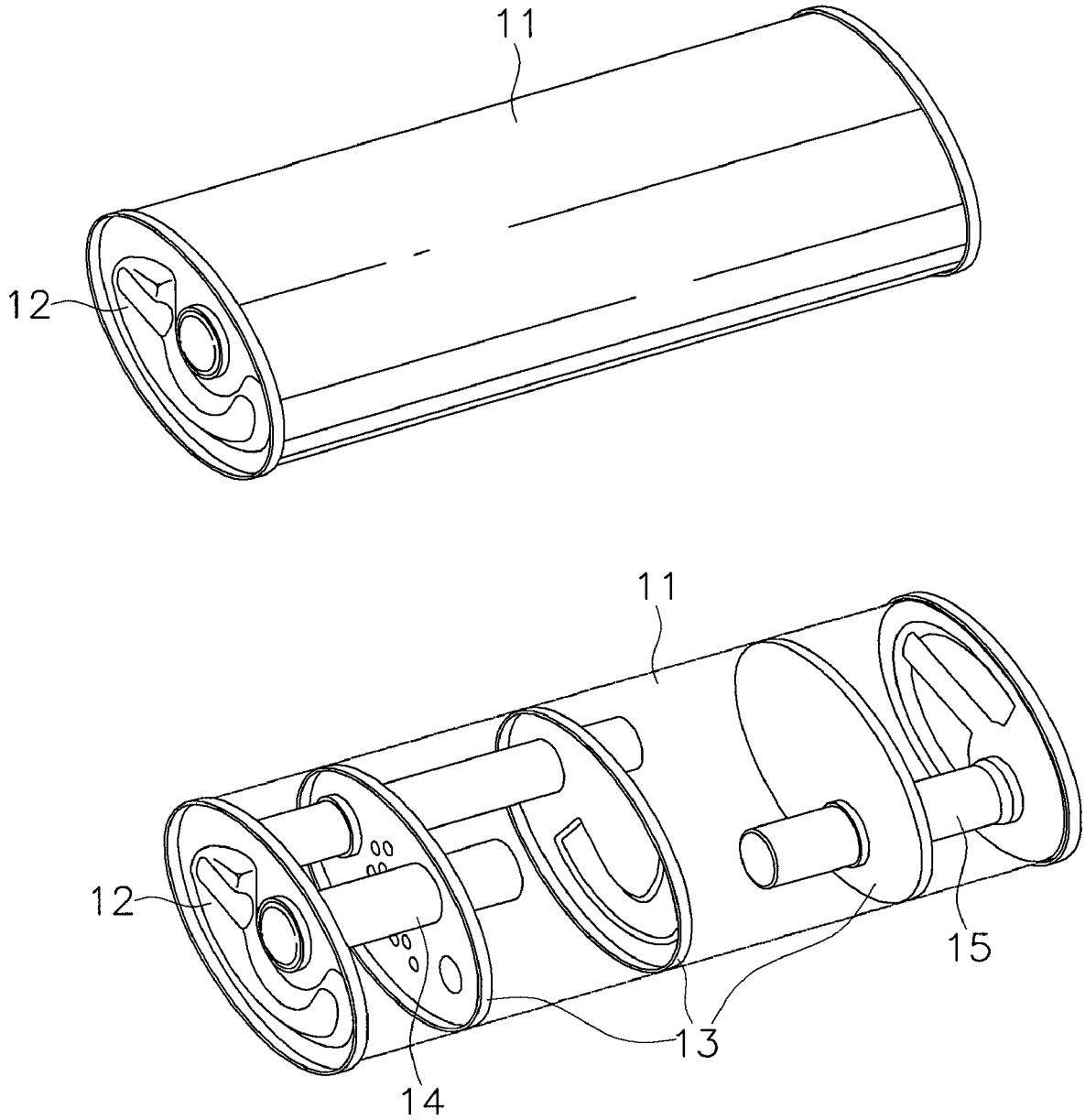
FIG.2 (Prior Art)
FIG. 2 is a perspective view of another muffler according to the related art.
Figure 3:
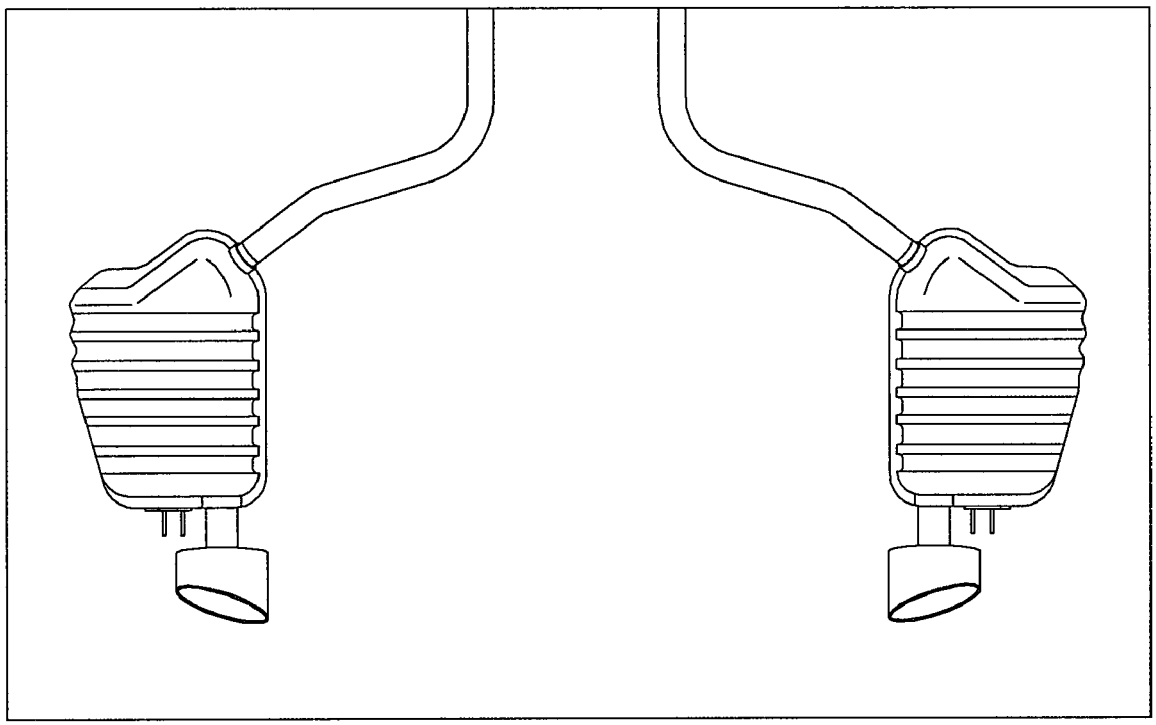
FIG.3 (Prior Art)
FIG. 3 is a plan view of a duel muffler according to the related art.
Figure 4:
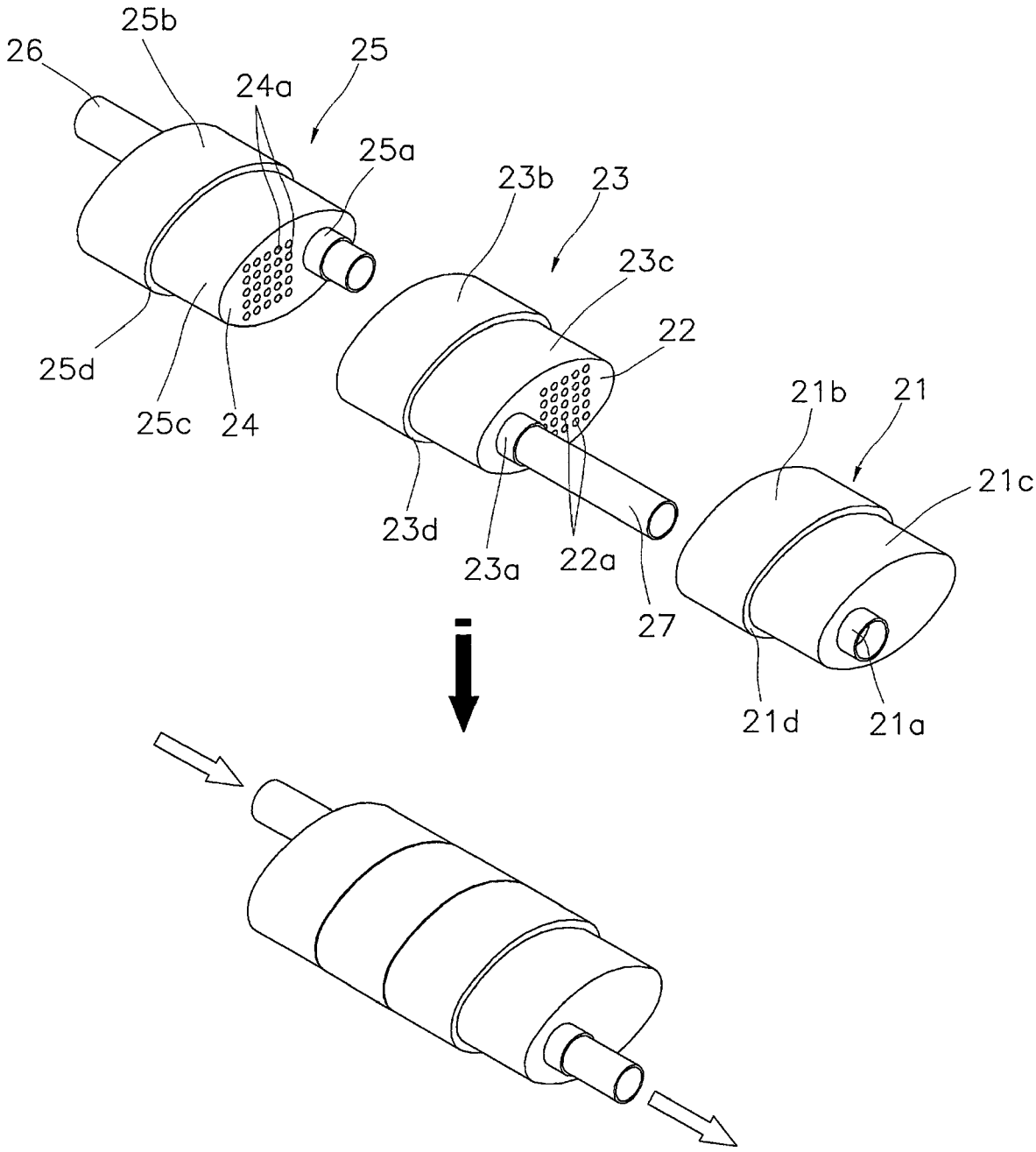
FIG. 4 is an exploded and assembled perspective view of an exemplary muffler of the present invention.

FIG. 4 is an exploded and assembled perspective view of an exemplary muffler for a vehicle according to the present invention, in which a muffler is formed by fitting a plurality of separate first, second, and third muffler bodies 21, 23, 25 to each other.

First muffler body 21 is constructed such that an opening is formed at one side of a cylinder having a predetermined volume therein, whereas the other front side opposite to the opening is closed, except for a boss 21*a* having a through hole to fit a pipe and integrally formed with the cylinder. The cylinder is formed of a large-diameter portion 21*b* and a small-diameter portion 21*c*, which are integrally connected to be stepped, such that an assembly guide step 21*d* is formed on the outer circumference therebetween.

Second muffler body 23 is also constructed such that an opening is formed at one side of a cylinder having a predetermined volume therein, whereas the other side opposite to the opening has a boss 23*a* having a through hole to fit a pipe and integrally formed with the cylinder, and a baffle 22 having a plurality of punched holes 22*a*. The cylinder is formed of a large-diameter portion 23*b* and a small-diameter portion 23*c*, which are integrally connected to be stepped, such that an assembly guide step 23*d* is formed on the outer circumference therebetween.

Third muffler body 25 is also constructed such that an opening is formed at one side of a cylinder having a predetermined volume therein, whereas the other side opposite to the opening has a boss 25*a* having a through hole to fit a pipe and integrally formed with the cylinder, and a baffle 24 having a plurality of punched holes 24*a*. The cylinder is formed of a large-diameter portion 25*b* and a small-diameter portion 25*c*, which are integrally connected to be stepped, such that an assembly guide step 25*d* is formed on the outer circumference therebetween.

Boss 23*a* and Punched holes 22*a* of first baffle 22 of the second muffler body are formed at the opposite side to boss 25*a* and punched holes 24*a* of second baffle 24 of the third muffler body.

Further, in third muffler body 25, an exhaust gas inflow pipe 26 that guides exhaust gas discharged from the engine into the muffler extends from the opening through second baffle 24 while passing through boss 25*a* of second baffle 24, whereas an exhaust gas outflow pipe 27 that guides the exhaust gas, which has flowed in the muffler, to the outside of the muffler extends from the inside of second muffler body 23 through boss 23*a* of first baffle 22, while passing through boss 21*a* of first muffler body 21.

Figure 5:
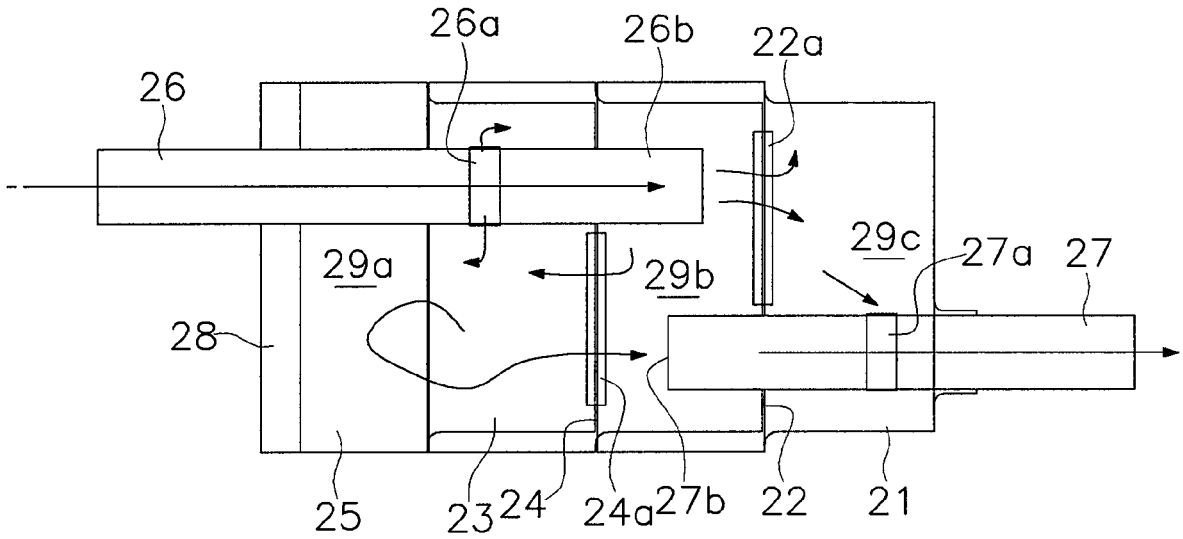
FIG. 5 is a cross-sectional view of the exemplary muffler of the present invention.

FIG. 5 is a cross-sectional view of the exemplary muffler according to the present invention, in which an end cap 28 is fitted to the opening of third muffler body 25 to close third muffler body. Accordingly, in the muffler, a first chamber 29*a* is defined from the end cap of third muffler body 25 to second baffle 24, a second chamber 29*b* is defined from second baffle 24 to first baffle 22 of second muffler body 23, and a third chamber 29*c* is defined from first baffle 22 to the closed end of first muffler body 21.

A front end 26*b* of exhaust gas inflow pipe 26 extends to the inside of second chamber 29*b*, a rear end 27*b* of exhaust gas outflow pipe 27 disposed to extend beyond front end 26*b* of the exhaust gas inflow pipe in second chamber 29*b*, and a plurality of punched holes 26*a*, 27*a* are formed at exhaust gas inflow pipe 26 and exhaust gas outflow pipe 27, respectively.

Exhaust gas flowing into the muffler through exhaust gas inflow pipe 26 is guided into the second chamber, a portion of the exhaust gas in the second chamber flows into the first chamber through first baffle 22 and then is discharged outside the muffler through the punched holes of the exhaust gas outflow pipe, and the other exhaust gas in the second chamber flows into the first chamber again through second baffle 24. Further, exhaust gas that has flowed in the first chamber through punched holes 26*a* of the exhaust gas inflow pipe while the exhaust gas flows through the exhaust gas inflow pipe is changed in direction and discharged outside the muffler through the exhaust gas outflow pipe, such that the pressure and noise of the exhaust gas are reduced.

With reference to the cross-sectional view of FIG. 5, in various embodiments of the present invention, the muffler can be appropriately changed for engines by adjusting the insertion positions of pipes 26, 27 and the positions of their punched holes to set the flow path of the exhaust gas in various ways.

Figure 6:
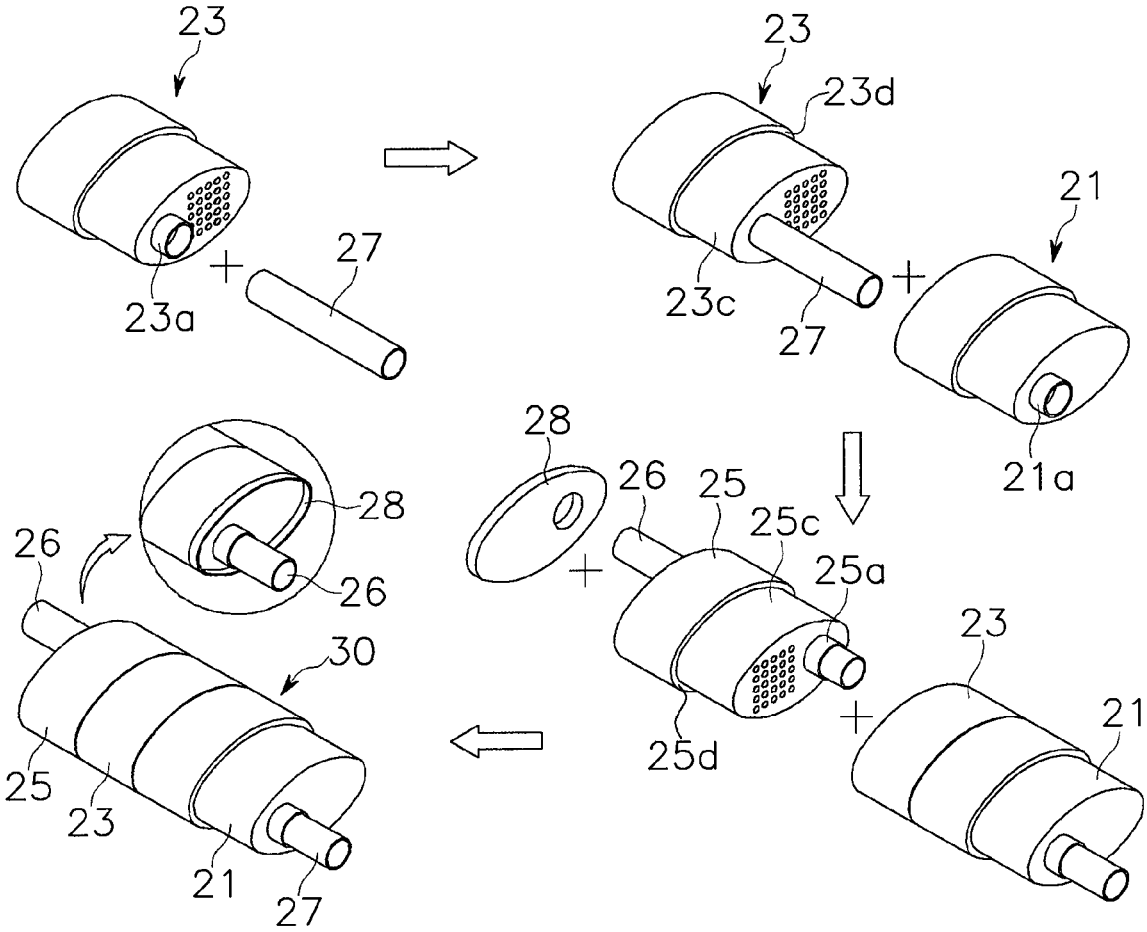
FIG. 6 is a view illustrating the manufacturing process of the exemplary muffler of the present invention.

Describing the manufacturing process of the muffler according to various embodiments of the present invention with reference to FIG. 6, exhaust gas outflow pipe 27 having the punched holes is first fitted in the boss of second muffler body 23 that is individually manufactured and then the exhaust pipe outflow pipe is welded throughout the circumference of the boss to be integrally attached. Subsequently, exhaust gas outflow pipe 27 and small-diameter portion 23*c* of second muffler body are inserted through the opening of first muffler body 21 such that the exhaust gas pipe passes through boss 21*a*, and then the exhaust gas pipe is welded throughout the circumference of boss 21*a* to be integrally attached. In this configuration, the outer edge of the large-diameter portion of the first muffler body is in close contact to assembly guide step 23*d* of the second muffler body, such that assembly guide step 23*d* functions as a guide when the second muffler body and the first muffler body is combined, and assembly guide step 23*d* is welded throughout the circumference to integrally combine the second muffler body with the first muffler body.

Thereafter, exhaust gas inflow pipe 26 is fitted in boss 25*a* of third muffler body 25 and welded throughout the circumference to be integrally combined, and then end cap 28 closes the opening of third muffler body 25 and welded to be integrally combined. The small-diameter portion of third muffler body assembled as described above is inserted through the opening of second muffler body, in which assembly guide step 25*d* of the third muffler body functions as an assembly guide and is welded throughout the circumference of the large-diameter portion of the second muffler body to be integrally combined, and as a result, the entire muffler is completed.

It is preferable to form the muffler bodies with baffles using a press.

Although one muffler is achieved by combining three, that is, first, second, and third muffler bodies 21, 23, 25 in various embodiments of the present invention, it is possible to achieve one muffler by combining two, or four or more muffler bodies, depending on types of engines or vehicles.

Further, since the front end of the exhaust gas inflow pipe extends beyond the rear end of the exhaust gas outflow pipe in the chamber, the exhaust gas discharged through the exhaust gas inflow pipe has to change the direction to inflow into the exhaust gas outflow pipe, such that flow resistance of the exhaust gas increases and exhaust noise can be reduced.

Figure 7:
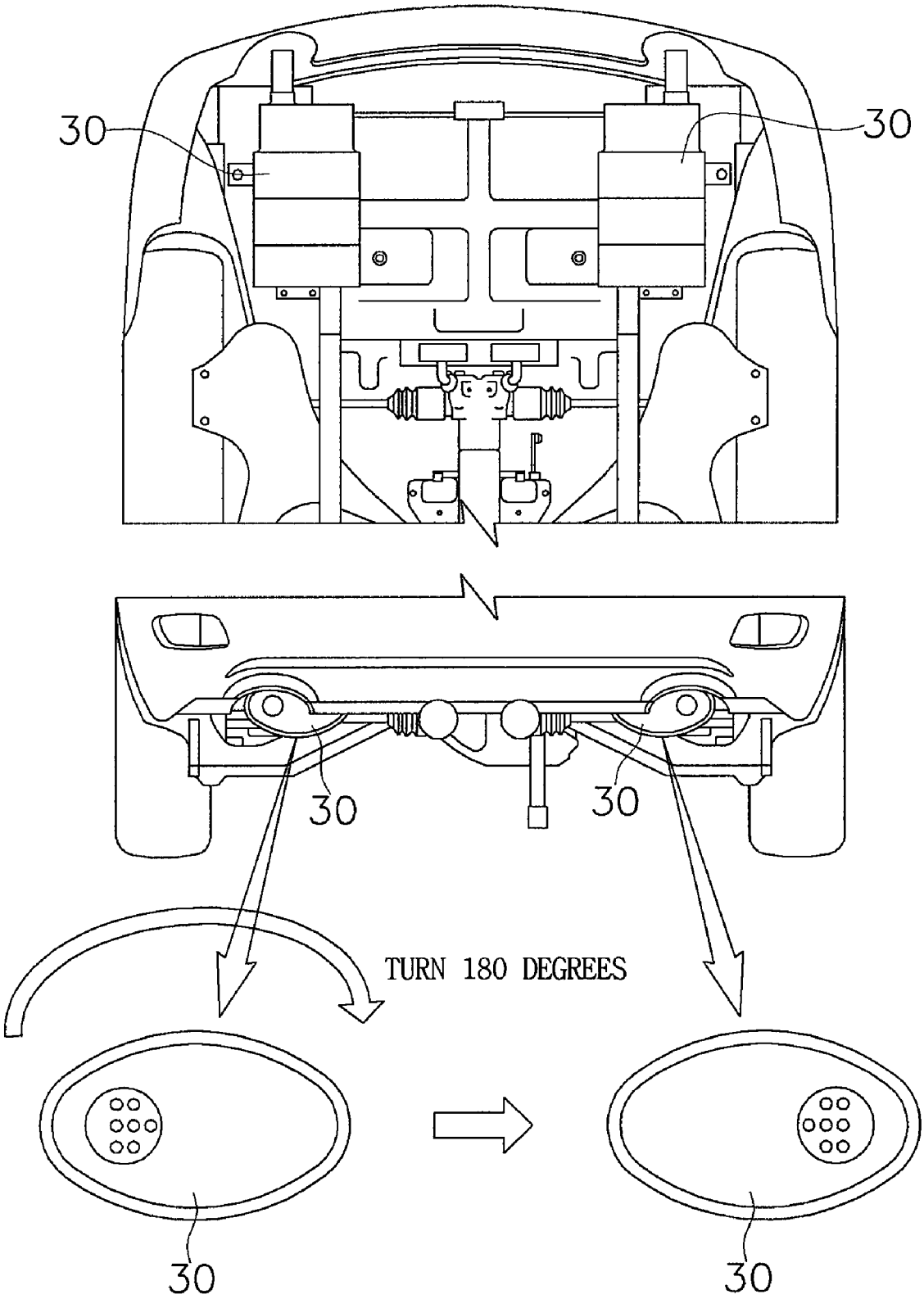
FIG. 7 is a view illustrating the muffler, which equipped with an exemplary duel muffler, according to the present invention.

When a duel muffler needs as shown in FIG. 7, for example, it is possible to install a muffler manufactured as described above as the left muffler and then install the muffler as the right muffler, after turning 180 degrees, such that the muffler according to various embodiments can be used for the left and right mufflers, without individually manufacturing the left and right mufflers.

Figure 8:
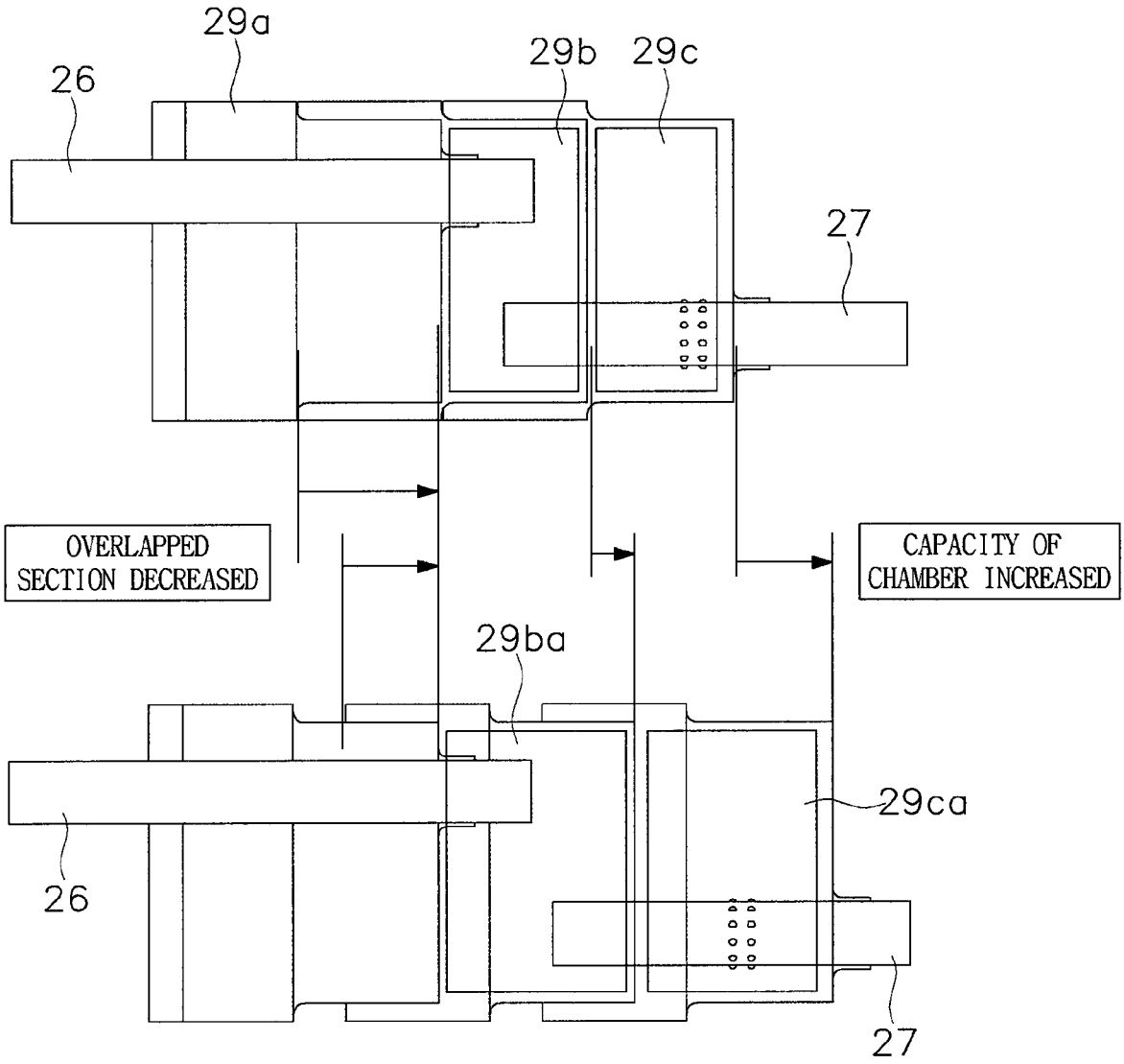
FIG. 8 is a view illustrating a modification of the exemplary muffler of the present invention.

As shown in FIG. 8, it is possible to achieve a second chamber 29*ba* and a third chamber 29*ca* having larger volume than second chamber 29*b* and third chamber 29*c* according to the above embodiments by decreasing the overlapped distance between the third muffler body and the second muffler body and the overlapped distance between the second muffler body and the first muffler body. Therefore, since the volume of the chambers can be easily changed, it is possible to more freely design the muffler for NHV tuning and easily achieve mufflers having appropriate structure for types of engines and vehicles, such that it is possible to apply the muffler to all the types of engines and vehicles.

For convenience in explanation and accurate definition in the appended claims, the terms "front" and "rear" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle, comprising:

a first muffler body including a housing, one end portion and an other end portion which are closed so as to form a first chamber therein;

at least a second muffler body, each including a housing, one end portion which is opened and an other end portion which is closed, wherein one of the second muffler bodies is configured to be fitted into the other end portion of the first muffler body to form a second chamber therein, and other second muffler bodies configured to be fitted into each other through the opened end portions thereof in series to form third or additional chambers therein in case that more than one second muffler bodies are assembled;

an inflow pipe configured and dimensioned to fluid-connect the outside with the at least one of the chambers by passing the one end portion of the first muffler body into one of the chambers and an outflow pipe configured and dimensioned to fluid-communicate one of the chambers with the outside by passing through the other end portion of the last second muffler body.

2. The muffler for a vehicle as defined in claim 1, wherein the first muffler body includes an opening at the one end portion thereof and a through hole at the other end portion thereof to receive the inflow pipe therethrough.

3. The muffler for a vehicle as defined in claim 2, wherein a boss is formed around the through hole at the other end portion to receive the inflow pipe therethrough.

4. The muffler for a vehicle as defined in claim 1, wherein the other end portion of the first muffler body includes at least a punched hole.

5. The muffler for a vehicle as defined in claim 1, wherein the second muffler body includes a through hole at the other end portion thereof to receive the outflow pipe therethrough.

6. The muffler for a vehicle as defined in claim 5, wherein a boss is formed around the through hole at the other end portion thereof to receive the outflow pipe therethrough.

7. The muffler for a vehicle as defined in claim 1, wherein the other end portion of the second muffler body includes at least a punched hole.

8. The muffler for a vehicle as defined in claim 1, wherein the housings of the first and second muffler bodies respectively include a large-diameter portion and a small-diameter portion, and an assembly guide step is integrally formed therebetween to connect the large-diameter portion and the small-diameter portion.

9. The muffler for a vehicle as defined in claim 8, wherein an outer diameter of the small-diameter portion in each muffler body is approximately the same as an inner diameter of the large-diameter portion of neighboring muffler body.

10. The muffler for a vehicle as defined in claim 1, wherein the inflow pipe is connected to an engine so as to receive exhaust gas and thus the exhaust gas is discharged outside the muffler through the outflow pipe.

11. The muffler for a vehicle as defined in claim 1, wherein the one end portion of the first muffler body includes an end cap that closes the first muffler body.

12. The muffler for a vehicle as defined in claim 1, wherein a front end of the inflow pipe extends beyond a rear end of the outflow pipe in the muffler.

13. The muffler for a vehicle as defined in claim 1, wherein at least a punched hole is formed around the inflow pipe.

14. The muffler for a vehicle as defined in claim 13, wherein the punched holes of the inflow pipe are disposed in one of the first, second, and/or third chambers.

15. The muffler for a vehicle as defined in claim 1, wherein at least a punched hole is formed around the outflow pipe.

16. The muffler for a vehicle as defined in claim 15, wherein the punched holes of the outflow pipe are disposed in one of the first, second, and/or third chambers.

17. The muffler for a vehicle as defined in claim 1, wherein a center axis of the inflow pipe is disposed offset from a center axis of the first muffler body in a longitudinal direction thereof.

18. The muffler for a vehicle as defined in claim 1, wherein a center axis of the outflow pipe is disposed offset from a center axis of the second muffler body in a longitudinal direction thereof.

19. The muffler for a vehicle, wherein a duel muffler is formed by disposing a plurality of mufflers as defined in claim 1, which is composed of the one or more first muffler bodies and the one or more second muffler bodies fitted in the first muffler bodies, to the left and right sides of the vehicle, wherein each inflow pipe of the mufflers is connected to an engine.

* * * * *